US005623888A

United States Patent [19]

Zafiroglu

[11] Patent Number: 5,623,888

[45] Date of Patent: Apr. 29, 1997

[54] BULKY, STABLE NONWOVEN FABRIC

[75] Inventor: Dimitri P. Zafiroglu, Greenville, Del.

[73] Assignee: E. I. Du Pont de Nemours and Company, Wilmington, Del.

[21] Appl. No.: 379,385

[22] Filed: Jan. 27, 1995

Related U.S. Application Data

[63] Continuation-in-part of Ser. No. 52,322, Apr. 22, 1993, abandoned.

[51] Int. Cl.[6] ..... D05B 35/08; B32B 5/04

[52] U.S. Cl. ..... 112/414; 112/475.04; 428/152

[58] Field of Search ..... 112/402, 413, 112/414, 420, 427, 2.1, 7, 117, 475.02, 475.04, 475.17; 428/102, 181, 182, 224, 152, 303, 340, 240, 283, 230, 906.6; 28/155, 157; 66/191, 192; 223/30, 243.1

[56] References Cited

U.S. PATENT DOCUMENTS

| | | | |
|---|---|---|---|
| 793,870 | 7/1905 | Beale | 112/427 X |
| 1,265,920 | 5/1918 | Lack | 112/427 X |
| 1,992,603 | 2/1935 | Burgess | 112/427 |
| 1,995,828 | 3/1935 | Troy | 428/152 X |
| 3,468,748 | 9/1969 | Bassett | 161/122 |
| 3,575,782 | 4/1971 | Hansen | 161/141 |
| 4,606,964 | 8/1986 | Wideman | 428/152 |
| 4,704,321 | 11/1987 | Zafiroglu | 112/413 |
| 4,737,394 | 4/1988 | Zafiroglu | 428/102 |
| 4,773,238 | 9/1988 | Zafiroglu | 66/192 |
| 4,876,128 | 10/1989 | Zafiroglu | 428/102 |
| 4,879,169 | 11/1989 | Zafiroglu | 428/230 |
| 5,008,141 | 4/1991 | Shinozuka | 112/402 |
| 5,080,267 | 1/1992 | Yogo | 112/132 X |
| 5,192,600 | 3/1993 | Pontrelli et al. | 112/420 X |
| 5,203,186 | 4/1993 | Zafiroglu | 428/102 X |
| 5,279,878 | 1/1994 | Fottinger et al. | 428/340 X |

*Primary Examiner*—Ismael Izaguirre

[57] ABSTRACT

A bulky, resilient, durable, dimensionally stable nonwoven fabric is prepared by (a) intermittently attaching contractible elements to a nonwoven fibrous layer, (b) contracting the elements to simultaneously gather the fibrous layer to 25–75% of its original area and form a series of waves or protuberances that project from the plane of the layer and then (c) stitchbonding the gathered fibrous layer with inextensible inelastic yarn. The fabrics are particularly useful for toweling, insulating layers, fire-resistant cloths, upholstery and the like.

9 Claims, 2 Drawing Sheets

BULKY, STABLE NONWOVEN FABRIC

RELATED APPLICATION

This is a continuation in part of application Ser. No. 08/052,322, filed Apr. 22, 1993, now abandoned.

BACKGROUND OF THE INVENTION

1. Field of the Invention

This invention relates to a process for preparing a gathered nonwoven fabric and the novel product made thereby. More particularly, the invention concerns such a process in which a gathered fibrous layer is rendered dimensionally stable and wash durable by over-stitching the gathered fibrous layer with inelastic yarn. The resultant fabric is particularly useful for toweling, upholstery, insulation, fire-resisting layers and the like.

2. Description of the Prior Art

Processes are known wherein a nonwoven fibrous layer is buckled, shirred, gathered or puckered (all of which terms are referred to hereinafter as "gathered"), so that the final area of the gathered nonwoven fibrous layer is much smaller than the original area of the layer. Such processes are disclosed, for example, by Bassett U.S. Pat. No. 3,468,748, Hansen U.S. Pat. No. 3,575,782, Wideman U.S. Pat. No. 4,606,964, and Zafiroglu U.S. Pat. No. 4,773,238. The contraction can cause the nonwoven fibrous layer to buckle out of plane and form series of waves or protuberances that project from the plane of the layer. Although the known gathered fabrics are useful in some applications, the fabrics often have shortcomings, such as being excessively stretchable, too easily compressible, insufficiently bulky and/or lacking in resilience, which make the fabrics unsatisfactory for use in materials that require high absorbency, high thermal insulating value, strong fire resistance, or the like. Accordingly, an aim of this invention is to provide a process for preparing a gathered nonwoven fabric in which the aforementioned shortcomings are ameliorated.

SUMMARY OF THE INVENTION

The present invention provides a process for preparing a durable, dimensionally stable, nonwoven fabric comprising the steps of intermittently attaching an array of contractible elements to a nonwoven fibrous layer of 15 to 100 g/m$^2$, preferably 30 to 70 g/m$^2$, the nonwoven fibrous layer having a length, a width, a longitudinal direction and a transverse direction, the longitudinal direction and the transverse direction respectively being parallel to the length and width of the nonwoven layer, the length and width together defining an original planar area of the nonwoven layer, contracting the array of contractible elements thereby causing the nonwoven fibrous layer to buckle and gather into an area that is in the range of 25 to 75%, preferably 30 to 50%, of the original planar area, the buckling creating a series of waves or protuberances that project generally perpendicularly from the planar area of the layer and increase the layer thickness to a thickness in the range of 1 to 8 millimeter, preferably 2 to 5 mm, the waves or protuberances having a spacing frequency of 2 to 8 per cm, preferably in the range of 4 to 6 per cm, in the longitudinal and/or transverse directions of the layer, and then over-stitching the gathered and buckled fibrous layer with a substantially inextensible, nonelastic yarn to form parallel rows of inter-connected stitches extending generally along the longitudinal direction of the gathered layer, the stitches being in the range of 1 to 6 mm apart within each row and the parallel rows being in the range of 1 to 6 mm apart, the inelastic thread of the over-stitching amounting to 5 to 50 percent, preferably 10 to 25%, of the total weight of the resultant over-stitched and gathered nonwoven fabric. A preferred stitch pattern for the over-stitching is provided by tricot stitching. Typically, the array of contractible elements that is intermittently attached to the nonwoven fibrous layer comprises elastic yarns that are stitchbonded to the layer while the elastic yarns are extended under tension and then the tension is removed from the elastic yarns to cause contraction of the elastic yarns and buckling of the nonwoven fibrous layer.

Novel products made by the process of the invention comprise a gathered, buckled fibrous nonwoven layer having waves or protuberances projecting generally perpendicularly from the flat plane of the layer, the waves or protuberances having a spacing frequency in the range of 2 to 8 per cm, preferably in the range of 4 to 6 per cm, the gathered layer having rows of interconnected over-stitches of substantially inextensible, inelastic yarn stitched through the layer and extending generally along the longitudinal direction of the gathered layer, the over-stitches being in the range of 1 to 6 mm apart within each row and the parallel rows being in the range of 1 to 6 mm apart, the inelastic thread amounting to in the range of 5 to 50%, preferably 10 to 25%, of the total weight of the stitched gathered layer, the over-stitched gathered layer having a weight in the range of 100 to 250 g/m$^2$, a total thickness in the range of 1 to 8 mm, and a stretchability in the longitudinal and/or transverse direction of no greater than 20%, preferably in the range of 5 to 15%.

BRIEF DESCRIPTION OF THE DRAWINGS

The invention will be more readily understood by reference to the drawings in which.

DETAILED DESCRIPTION OF PREFERRED EMBODIMENTS

Figure 1:
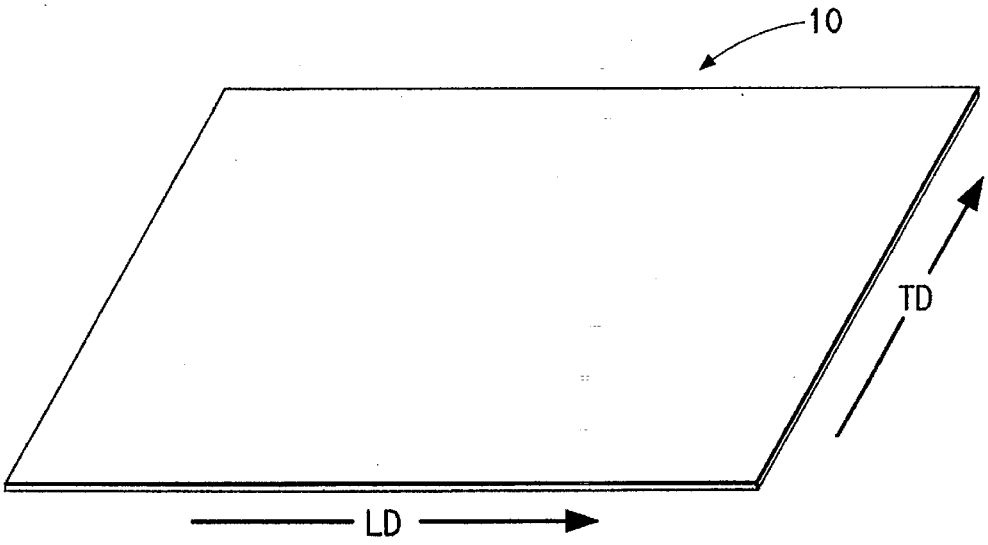
FIG. 1 is a diagrammatic representation of an enlarged sample cut from nonwoven fibrous layer 10, with the longitudinal and transverse directions indicated by arrows LD and TD, respectively.
Figure 2:
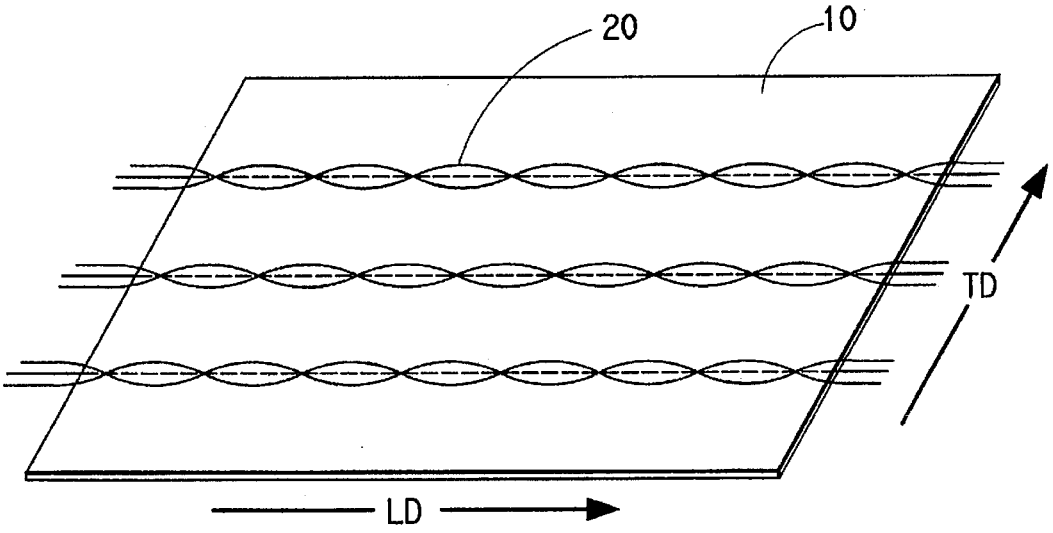
FIG. 2 represents the enlarged cut sample of layer 10 of FIG. 1, chain-stitched with pretensioned elastic yarns 20.
Figure 3:
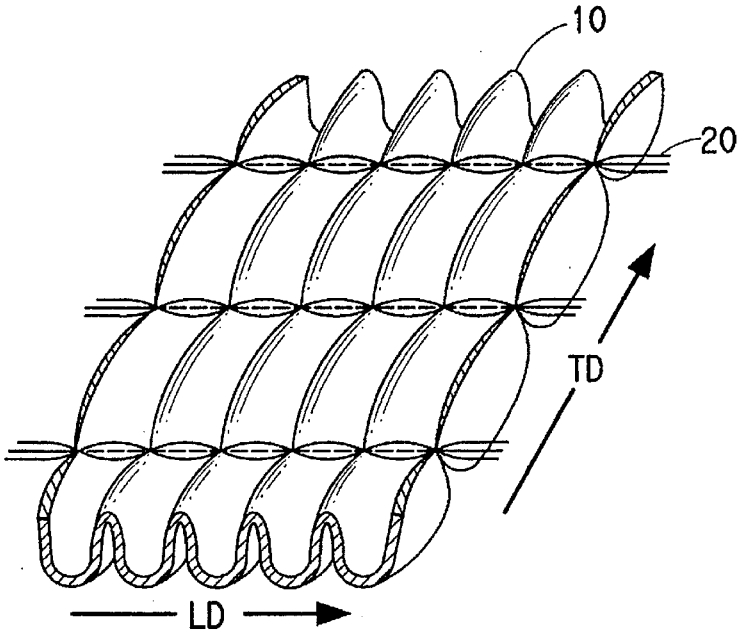
FIG. 3 represents the enlarged cut sample of layer 10 after the tension has been released from pretensioned elastic yarns 20 and the yarns contracted longitudinally by about 50% and the fibrous layer has and buckled to about 50% of its original area.
Figure 4:
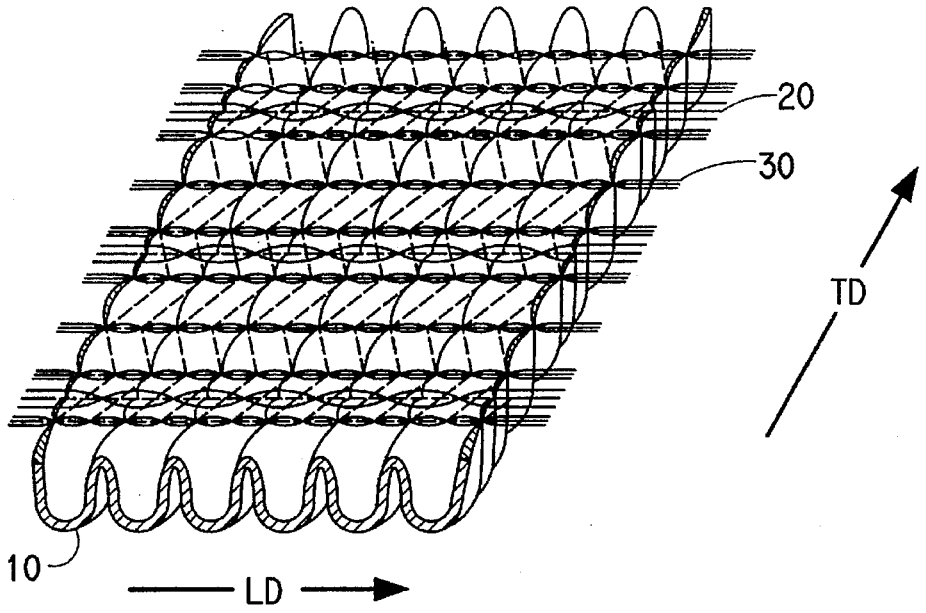
FIG. 4 represents the enlarged cut sample of layer 10 after elastic yarns 20 are no longer under tension and the buckled layer has been over-stitched with tricot stitches formed by inelastic yarns 30. In the figures, yarns 20 and 30 are extended beyond the cut edges of the sample for greater clarity.

The invention is further illustrated by the following description of preferred embodiments. These are included for purposes of illustration and are not intended to limit the scope of the invention, which is defined by the appended claims.

As noted above, in accordance with the first step of the process of the present invention, contractible elements, for example contractible or elastic yarns, are attached intermittently to a nonwoven fibrous layer. Then, the contractible elements are caused to contract. As a result, the nonwoven fibrous layer gathers and decreases in planar area to an area that typically is 25 to 75% of its original planar area (i.e., the planar area prior to contraction). Preferably, the area is reduced to 30 to 50% of the original area. Thereafter, the gathered layer is over-stitched with substantially inextensible, inelastic yarn.

As the intermittently attached contractible elements contract, the fibrous layer gathers and forms a repetitive series of waves or protuberances that project substantially perpendicularly from the flat plane of the fibrous layer. When the fibrous layer gathers substantially only in its length (i.e., longitudinal direction), the waves that are formed extend across the width of the layer (i.e., in the transverse direction). When the fibrous layer gathers substantially only in the transverse direction, the waves that are formed extend along the length of the layer. When the fibrous layer gathers in both the longitudinal and transverse directions, series of protuberances form and extend in both the longitudinal and transverse directions of the layer. During the contraction and buckling, the thickness and unit weight of the fibrous layer are significantly increased.

After the fibrous layer has been gathered, the gathered layer is over-stitched, typically by multi-needle stitchbonding techniques, with substantially inextensible, inelastic yarn. The over-stitching can cause a decrease in the thickness of the gathered fibrous layer. Usually the decrease is less than 20%, typically in the range of 5 to 15%. The over-stitching of the gathered fibrous layer provides the resultant nonwoven fabric with dimensional stability in the longitudinal and/or transverse stitching directions of the fabric, as well as in the thickness of the fabric. Thus, the nonwoven fabric is bulky, resilient, durable to repeated laundering and of low stretchability in the longitudinal and/or transverse directions (i.e., no greater than 20%, usually in the range of 5 to 15%).

The starting nonwoven fibrous layer that is to be gathered in accordance with the invention typically is a thin, supple web of staple fibers, continuous filaments, plexifilamentary strands or the like. The term "fibers" is used collectively herein to include each of these fibrous materials. The fibers may be natural fibers or may be formed from synthetic organic polymers. Preferably the fibers are not bonded to each other. However, if the nonwoven fibrous layer is thin and supple enough to be capable of buckling satisfactorily over a short span, the layer can be of bonded fibers. Preferred starting nonwoven fibrous layers are capable of buckling, as shown in the examples below, over intervals in the range of 3 to 12 mm. The starting layer typically weighs in the range of 15 to 100 g/m$^2$, preferably less than 30 to 70 g/m$^2$.

Suitable starting nonwoven fibrous layers are selected, to some extent, based on the desired end-use for the nonwoven fabric that is to be produced. For example, for absorbent fabrics, the starting nonwoven fibrous layer is preferably substantially not bonded, and composed of fibers that inherently can absorb or wick liquid (e.g., rayon and woodpulp for water absorption). Similarly, fire resistant fabrics require starting fibrous layers of fibers that are inherently flame-resistant (e.g., aramid fibers). Suitable starting fibrous layers include carded webs, air-laid webs, wet-laid webs, spunlaced fabrics, spunbonded sheets, sheets of flash-spun strands, and the like. For resilient cushion products, somewhat denser fibrous layers, in which the fibers preferably are somewhat bonded to each other, are satisfactory. These suitable materials can be used alone for starting fibrous layers or in combination with other layers intended for conventional or special purposes. Webs that are felted, strongly bonded by heat or adhesives, or the like, often are difficult to gather and buckle and therefore usually are not suited as fibrous layer for use in the invention.

The gathering and buckling of the nonwoven fibrous layer with intermittently attached contractible elements can be accomplished in any of several known ways. Contraction of the contractible element or array of contractible elements causes the fibrous layer to contract and buckle and thereby significantly decreasing the planar area (i.e., projected flat area) of the layer. Additional gathering can be imparted to the fibrous starting layer, before the contractible element or array of elements is attached to the fibrous layer by over-feeding the layer to the apparatus being employed to attach the contractible elements.

Many types of contractible elements are suitable for use in preparing the gathered fibrous layer in accordance with the invention. For example, the nonwoven fibrous layer can be stitch-bonded with elastic yarns under tension. Covered or bare spandex yarns, textured stretch yarns, composite yarns of elastic filaments and inelastic fibers, and the like are suitable elastic yarns. After stitching under tension, the tension can be released from the elastic yarn to cause the yarn to contract and the fibrous layer to gather and buckle. Instead of stitching with elastic yarns, warps or cross warps of tensioned and extended elastic elements can be attached intermittently to the nonwoven fibrous layer, for example, by hydraulic entanglement, adhesive or thermal point bonding or the like, and thereafter, tension on the extended elements can be released to cause the attached nonwoven fibrous layer to gather and buckle. Conventional stitchbonding patterns of stitches can be employed to produce the gathered fibrous nonwoven layer. Usually, the elastic yarn stitches are spaced in the range 1 to 12 mm apart in the longitudinal direction (i.e., within the rows of stitches) and the parallel rows of stitches are spaced about 1 to 25 mm apart. Chain stitches of tensioned elastic yarn are suitable for gathering the fibrous layer in the longitudinal direction. Tricot stitches are suitable for gathering the fibrous layer in the both the longitudinal and transverse directions.

Other types of contractible elements, such as those that shrink on being treated with heat, moisture, chemicals or the like, can be attached intermittently to the nonwoven fibrous layer without initial tension or extension in the elements. After attachment, contraction of the contractible elements can be activated by appropriate treatment. Typically, when elastic yarns are used as the contractible filaments, the elastic filament content of amounts to in the range of about 3 to 10% of the weight of the fibrous layer to which the yarn is stitched or attached.

Another way of accomplishing the gathering and buckling of the nonwoven fibrous layer involves intermittently attaching the fibrous layer to a stretchable substrate that necks-in in a direction perpendicular to the direction in which the substrate is tensioned. For example, certain substrates, when stretched by 15% in one direction, can automatically experience substantially irreversible contraction (i.e., neck in) in a direction perpendicular to the stretch direction, by an amount that is two or three times the percentage stretch. Thus, intermittent attachment of a fibrous layer to the stretchable substrate before the stretching and necking-in operation, and then applying the stretching forces to the assembled fibrous layer and stretchable substrate, can significantly decrease the area of the fibrous layer and cause buckling of groups of fibers as required by the process of the invention.

Still another method of gathering the nonwoven fibrous layer is to intermittently attach the layer to a tensioned, extended elastic sheet and then to allow the sheet tension to be released to thereby contract the sheet and gather the fibrous layer.

A preferred method for accomplishing the gathering step is to stitch the fibrous substrate with elastic yarns under tension and then release the tension from the yarns. Covered or bare elastomeric yarns that have a high unload power are particularly preferred. Nylon-covered or polyester-covered spandex yarns or spandex-containing composite or combination yarns are particularly suited for this purpose. If the starting fibrous web is sufficiently light in weight (e.g., 20–40 g/m$^2$) textured yarns of nylon or polyester can provide sufficient unload power to gather the starting fibrous substrate.

After the initial gathering step has been completed, the gathered nonwoven fibrous layer is over-stitched with conventional, substantially inextensible, inelastic yarn (also sometimes referred to hereinafter as "hard yarn"), preferably with a stitchbonding machine, such as a Liba or Mali or Arachne machine. The inextensible, inelastic yarn forms parallel rows of over-stitches along the length of the fabric having a spacing in the range of 1 to 6 mm within the rows and a spacing between the parallel rows in the range of 1 to 6 mm. The stitch spacing and row spacing is determined by the machine gauge (i.e., the number of stitching needles per 25.4 mm of needle bar) and number of stitches inserted per unit length fed through the machine. Alternatively, the row and stitch spacings can be determined from visual inspection of the surface of the over-stitched nonwoven fabric, conveniently under a magnification of about 3 to 5×. Under such magnification, the number of over-stitches per unit length in the longitudinal direction and the number of rows of over-stitches per unit width in the transverse direction can be readily measured. Typically, stitch and row spacings are each in the range of 1 to 6 mm.

Conventional hard yarns of nylon, polyester, cotton or the like are suitable for use as the inextensible, inelastic over-stitching yarn. Conventional stitchbonding stitch patterns are suitable for the over-stitching. Chain stitches, provide dimensional stability in the direction of the row of chain stitches. Tricot stitches, depending on the length of the float in comparison to the spacing of the stitches in the row, provide two-directional dimensional stability. Typically, the over-stitching yarn amounts to in the range of 5 to 50%, usually 10 to 25%, of the total weight of the over-stitched and gathered nonwoven fabric.

The following methods and procedures are used to measure various characteristics of the gathered and over-stitched fabrics of the invention.

Unit weight of a fabric or fibrous layer is measured according to ASTM Method D 3776-79. Fabric bulk in cm$^3$/gram is determined from the thickness and unit weight of the fabric. Thickness is measured with a Starrett gauge, Model 25-631. The gauge applies a load of 10 grams to a cylindrical foot of 1-inch (2.54-cm) diameter, which is equivalent to a pressure of 0.03 psi (0.21 kiloPascals) on the surface of the fabric during the measurement.

Stretchability is used herein as a measure of dimensional stability. The stretchability of a fabric is determined by: (a) cutting a sample measuring 2-inches (5.1-cm) wide by 4-inches (10.2-cm) long from the fabric; (b) marking a standard length, $L_o$, parallel to the long dimension of the sample; (c) suspending a 5-pound (2.27-Kg) weight from sample for 2 minutes; (d) with the weight still suspended from the sample, re-measuring the "standard length", the re-measured length being designated $L_f$; and (e) calculating the percent stretchability, %S, by the formula, $\%S=100(L_f-L_o)/L_o$. By cutting some samples in the longitudinal direction ("LD") and others in the transverse direction ("TD") and performing steps (b) through (e) on the samples, the LD and TD stretchability of the sample is determined.

Resilience of a fabric is determined herein by: (a) measuring the thickness, $t_o$, of the fabric under a pressure of 0.03 psi (0.21 KPa) with a Starrett gauge as described above; (b) placing the fabric on a flat surface and then placing a 2-inch diameter plate loaded with a 5-pound weight atop the fabric, which is equivalent to a compressing the fabric under a pressure of 3.2 psi (22 KPa); (c) removing the weight after about ten seconds and allowing the fabric to recover for about one minute; (d) re-measuring the thickness of the fabric, $t_r$, under a pressure 0.03 psi (0.21 KPa); and (e) calculating the % resilience, %R, by the formula, $\%R=100(t_r/t_o)$.

The compressibility of the fabric is indicated herein by measurement of the thickness of the fabric under a compression of 2.3 psi (15.8 KPa) as determined with a Ames Comparator Model 24.

Fire resistance of a fabric is measured in accordance with the Vertical Flame Test of Method FS-5903 of the National Fire Protection Association. The thermal protection value of a fabric is determined in accordance with the Thermal Protection Performance test of ASTM D 4108-87.

EXAMPLES

The following Examples illustrate the preparation of gathered and over-stitched nonwoven fabrics of the invention and demonstrates the advantages of these fabrics over similar conventionally made fabrics that are outside the invention. The unit weight, thickness, bulk, resilience, and stretchability and other characteristics of each sample of the invention and each comparison sample are summarized in the tables that accompany the examples. Samples of the invention are designated with Arabic numerals; comparison samples, with upper case letters. The reported results are believed to be fully representative of the invention, but do not constitute all the tests involving the indicated yarns and fibrous materials.

Example I

This example illustrates the preparation of a gathered and over-stitched fabric of the invention that is suitable for use as an absorbent towel and as an absorbent layer in a hospital incontinence pad. Advantages in bulk, stability, compressibility, resilience and absorption capability are demonstrated for the nonwoven fabric of the invention, Sample 1, over two comparison samples that were of the same weight and same fibrous layer, but were not gathered. Comparison Sample A had the same over-stitching as Sample 1. For Comparison Sample B, the over-stitching was typical of a quilted product; the fibrous layers were over-stitched with yarns that formed 2-inch (5.1-cm) apart parallel rows of 2-inch (5.1-cm) long stitches. The characteristics of the samples are summarized in Table 1.

Sample 1 of the invention was prepared as follows. The starting fibrous layer was a 1.1-oz/yd$^2$ (37.3 g/m$^2$) spunlace fabric (Sontara® Style 8411) of hydraulically entangled fibers consisting of 70% rayon fibers of 1.5 denier (1.67 dtex) and 30% polyester fibers of 1.35 denier (1.5 dtex), both types of fibers being ⅞-inch (2.2-cm) long. The spunlace layer was fed to a Liba machine that had a single-bar threaded with elastic yarn. The elastic yarn was a 140-den (156-dtex) Lycra® spandex wrapped with 70-den (78-dtex) 34-filament textured polyester. Sontara® and Lycra® are made and sold by E. I. du Pont de Nemours & Co. Long open chain stitches (i.e., 1-0,0-1 in conventional knitting nomenclature) were stitched into the Sontara® at 4 stitches per inch (1.6/cm) 6 gauge (6 needles per 25.4 mm) with the yarn under a tension that extended the yarn to 460% of its relaxed length. Upon release of the tension, the fibrous layer gathered in the longitudinal direction to form series of waves extending across the width of the layer. The gathered area amounted was about 26% of the original area and weighed 5.5 oz/yd$^2$ (186 g/m$^2$). The thickness of the fibrous layer increased from 0.018 inch (0.46 mm) to 0.120 inch (3 mm).

The gathered fibous layer of the preceding paragraph could be elastically stretched by at least 200% in the longitudinal direction ("LD") and was readily and permanently deformable in the transverse direction ("TD"). The thusly gathered layer was then over-stitched on the Liba machine with the front bar forming 1-0,0-1 chain stitches and the back bar forming 1-0,2-3 tricot stitches. Both bars were threaded at 12 gauge (12 needles per 25.4 mm of width) with 70-den (78-dtex) textured polyester yarn and made 14 stitches/inch (5.5 per cm) in the longitudinal direction. The overstitching amounted to 13% of the total weight of the resultant gathered and over-stitched nonwoven fabric. This nonwoven fabric, Sample 1, weighed 6.2 oz/yd$^2$ (210 g/m$^2$); was 0.085-inch (2.2-mm) thick; had a resilience of 100%; was dimensionally stable in that it had a stretchability of 8% in the longitudinal direction and of 5% in the transverse direction of the fabric; and changed dimensions by no more than 10% in twenty-five C-wash cycles in a home laundry washing machine. Sample 1 exhibited the ability to absorb water amounting to 7.8 times the weight of the fabric. The water absorption was measured by dipping a 15.2-by-15.2 cm square sample in water, then removing the sample from the water, allowing water to drip from the sample for one minute while the sample was held suspended in air from one corner of the sample, and then comparing the weight of the wet sample with its original dry weight to determine the amount of water absorbed.

The two comparison samples were constructed in conventional ways. The comparison samples contained no gathered fibrous layer. Comparison Sample A was prepared from a stack of three nominally 1.1-oz/yd$^2$ (37.3-g/m$^2$) layers of Sontara® 8411 that were stitched together with the same polyester yarn and same stitch pattern as Sample 1, to form a product that weighed 7.1 oz/yd$^2$ (241 g/m$^2$) and measured 0.057-inch (1.4-mm) thick. Comparison Sample B was prepared from a stack of five layers of Sontara® 8411 that were quilted together with the same stitching thread as was used for Sample 1 and Comparison Sample A, but with a stitch spacing and a row spacing that each were of 2 inches (5 cm). Comparison Sample A was easily stretched by hand by more than 25% in both the LD and TD. Comparison Sample A could absorb only 4.3 times its own weight in water and shrank about 25% in both the LD and TD as the result of only one C-wash. Comparison Sample B, which weighed 6.0 oz/yd$^2$ (204 g/m$^2$) and measured 0.06- inch (1.5-mm) thick, was even more stretchable than Comparison Sample A and could not survive even one C-wash without showing evidence of deterioration and the start of tears and/or holes in the fabric. Additional data on the characteristics of Sample 1 and Comparison Samples A and B are summarized in the Table below. The recorded data clearly show the additional advantages of the Sample 1 of the invention over Comparison Samples A and B, especially with regard to stretchability, bulk, resilience and thickness under load.

Example II

In this example, a fabric which is suitable as the liner of a fireman's jacket, Sample 2, is prepared in accordance with the invention, and is compared Comparison Samples C and D, which were prepared in conventional ways from the same materials as Sample 2 but without a gathering step.

Sample 2 was made as follows. A 1.1-oz/yd$^2$ (37.3-g/m$^2$) spunlace layer of Sontara® type Z-11, which was composed of Kevlar® aramid fibers, was initially stitched with a yarn of 140den (156-dtex) Lycra® spandex that had been air-wrapped with roughly 6 wraps per inch (2.4/cm) of 200-den (222-dtex) Nomex® aramid yarn. During the stitching, the yarn was under a tension that extended the yarn to 350% of its relaxed length. Series of 1-0,0-1 chain stitches were inserted with the tensioned yarn into the spunlace layer at 6 gage and 4.5 stitches per inch (1.8/cm). Upon release of the tension on the stitching yarn, the fibrous layer gathered to an area that was about 33% of its original flat area and formed a series of waves extending across the width of the layer. Sontara®, Kevlar®, Nomex® and Lycra® are registered trademarks of products made and sold by E. I. du Pont de Nemours & Co. The gathered fibrous layer was then over-stitched with a 200-den (222-dtex) Nomex® aramid filament yarn using a two-bar Liba machine that was threaded at 12 gage and formed 9 stitches per inch in the LD (3.5/cm); the front bar formed 1-0,0-1 chain stitches and the back bar formed 1-0,2-3 tricot stitches. The thusly prepared nonwoven fabric was 0.085-inch (2.2 mm thick), weighed 7.2 oz/yd$^2$ (244 g/m2), was dimensionally stable, showed no deterioration after five C-washes, readily passed the Vertical Flame Test and was very effective effective in thermal protection, having a TPP value of 22.3 cal/cm$^2$.

Two comparison samples, C and D, were also prepared. For Sample C, a stack of three layers of the same starting nonwoven fibrous layer as was used for preparing Sample 2 were stitched with a two-bar Liba machine with both bars threaded with the same stitching yarn as was used in the first step for stitching the fibrous layer of Sample 2. Both bars were threaded at 12 gage and each formed 9 stitches per inch (3.54/cm) along the length of the stacked layers. The front bar formed chain stitches of 1-0,0-1 and the back bar formed tricot stitches of a 1-0,2-3 pattern. The resultant stitched assembly contracted about 10% in each of the LD and TD directions to achieve a final weight of 7.2 oz/yd$^2$ (244 g/m$^2$) and a thickness of 0.051 inch (1.3 mm). Although the comparison product passed the Vertical Flame Test, its performance in the TPP test indicated a value of only 17.8 cal/cm$^2$. Comparison Sample D was a stack of four "Sontara" Z-11 layers, each weighing a nominal 1.8 oz/yd$^2$ (61 g/m$^2$), quilted in the same pattern as Comparison Sample B, but with the same yarns as were used for Sample 2. Characteristics of Sample 2 of the invention and of Comparison Samples C and D are summarized and compared in the table below. Again the data, as in Example 1, demonstrate the advantages of the sample fabric of the invention over the comparison samples, particularly with regard to fabric stretchability, thickness, resilience, bulk, and resistance to compression.

Example III

This example illustrates the preparation of a fabric of the invention, Sample 3, in which the contractible elements that cause the buckling of the fibrous layer were attached to the fibrous layer by hydraulic entanglement techniques. A pre-tensioned 12-gage warp of 280-den (311-dtex) spandex yarns wrapped with 70-den (78-dtex) textured polyester yarns were extended to 350% of their relaxed length and placed on a 24-mesh screen having a 20% open area. A 1.1-oz/yd$^2$ (37.3 g/m$^2$) air-laid web of 1.5-den (1.7-dtex) 1.5-inch (3.9-cm) long rayon fibers was placed atop the warp. The thusly formed assembly was forwarded at 10 yards/min (9.1 m/min) through a series of columnar jets of water supplied through hydraulic 0.005-inch (0.127 -mm) diameter orifices located about 1 inch (2.5 cm) above the web and spaced 40 to the inch (15.7/cm) across the width of the web. Four passes were made under the jets, with the supply pressure to the orifices being increased on each pass so that the pressure in each pass was in succession 100, 300, 1000 and 1500 psi (690, 2070, 6890 and 10,300 KPa). The resultant air-dried product gathered upon release of the tension on the contractible elements to a thickness of 0.109 inch (2.8 mm). This intermediate fabric was stretchable and lacking in C-wash durability. The intermediate fabric was then over-stitched with the same stitching yarns at the same gage, same stitch frequency and same stitch pattern as was used to prepare Sample 1 of Example I. The final gathered and over-stitched nonwoven fabric weighed 5.3 oz/yd$^2$ (180 g/m$^2$) had a thickness of 0.075 inch (1.9 mm), was dimensionally stable and durable through at least 10 C-washes, with shrinkage of less than 10% in the longitudinal and transverse directions. The material was particularly useful as toweling in that the gathered and over-stitched nonwoven fabric absorbed water amounting to more than seven times its dry weight. Additional data are included in the table below. Note how favorably Sample 3 compares with the other samples of the invention, Samples 1 and 2, and how all the samples of the invention greatly exceed comparative Samples A, B, C and D (which were not gathered) in thickness, bulk, resilience, resistance to load and stretchability.

TABLE

| | Comparison of Fabric Samples | | | | | | |
|---|---|---|---|---|---|---|---|
| Example | I | I | I | II | II | II | III |
| Sample | 1 | A | B | 2 | C | D | 3 |
| Starting Layer | | | | | | | |
| Weight, g/m2 | 37.3 | 112 | 203 | 37.3 | 112 | 245 | 37.3 |
| Thickness, mm | 0.46 | 1.4 | 1.5 | 0.36 | 1.2 | 1.5 | 0.46 |
| Gathered Layer | | | | | | | |
| Weight, g/m2 | 186 | 112 | 203 | 149 | 112 | 245 | 136 |
| % original area | 26 | 100 | 100 | 33 | 100 | 100 | 29 |
| Final Fabric | | | | | | | |
| Weight, g/m2 | 210 | 241 | 204 | 244 | 244 | 244 | 180 |
| % Over-stitching | 13 | 18 | <1 | 32 | 39 | <1 | 16 |
| Stretchability | | | | | | | |
| LD, % | 8 | >25 | >25 | 10 | 30 | >25 | 8 |
| TD, % | 5 | >25 | >25 | 5 | 40 | >25 | 3 |
| Thickness, mm | 2.2 | 1.4 | 1.5 | 2.2 | 1.3 | 1.5 | 1.9 |
| Bulk, cm$^3$/g | 10.2 | 6.0 | 7.2 | 8.8 | 5.3 | 6.0 | 10.5 |
| % resilience | 100 | 79 | 48 | 107 | 84 | 48 | 102 |
| Thickness under load, mm | 0.66 | 0.35 | 0.43 | 0.69 | 0.46 | 0.25 | 0.68 |

Although the invention was illustrated with fibrous layers that are gathered and then over-stitched as separate fabrics, it is clear that such gathered and over-stitched fabrics of the invention also can be used as multiple superimposed layers or in combination with other gathered fabrics, flat fabrics or sheets.

I claim:

1. A process for preparing a durable, dimensionally stable, nonwoven fabric comprising in sequence, the steps of intermittently attaching an array of contractible elements to a nonwoven fibrous layer having a weight of 15 to 100 g/m$^2$, a length, a width, a longitudinal direction and a transverse direction, the longitudinal direction and the transverse direction respectively being parallel to the length and width of the nonwoven layer, and the length and width together defining the original planar area of the nonwoven layer, contracting the array of contractible elements thereby causing the nonwoven fibrous layer to buckle and gather into an area that is in the range of 25 to 75% of the original planar area, the buckling creating a series of waves or protuberances that project generally perpendicularly from the planar area of the layer and increase the layer thickness to a thickness in the range of 1 to 8 mm, the waves or protuberances having a spacing frequency of 2 to 8 per cm, in the longitudinal and/or transverse directions of the layer, and then over-stitching the gathered and buckled fibrous layer with a substantially inextensible, nonelastic yarn to form parallel rows of interconnected stitches extending generally along the longitudinal direction of the gathered layer, the stitches being in the range of 1 to 6 mm apart within each row and the parallel rows being in the range of 1 to 6 mm apart, the inelastic thread of the over-stitching having a weight that is 5 to 50 percent of the total weight of the resultant over-stitched and gathered nonwoven fabric.

2. A process in accordance with claim 1 wherein the fibrous layer weighs in the range of 30 to 70 g/m2, the gathered area is 30 to 50% of the original area, the buckled layer thickness is in the range of 2 to 5 mm, the waves or protuberances having a spacing frequency in the range of 4 to 6 per cm, and the layer being overstitched with tricot stitches that amount to 10 to 25% of the total weight of the nonwoven fabric.

3. A process in accordance with claim 1 or 2 wherein the array of contractible elements comprises elastic yarns that, in the attaching step, are placed under tension and extended thereby, and while extended are stitchbonded to the nonwoven fibrous layer and then in the contracting step, the tension is removed from the elastic yarns to cause contraction of the elastic yarns and the buckling of the nonwoven fibrous layer.

4. A process in accordance with claim 3 wherein the elastic yarns are composite yarns comprising elastic filaments and inelastic fibers.

5. A nonwoven fabric comprising a gathered, buckled, nonwoven fibrous layer with an intermittently attached array of contracted elastic elements, the nonwoven fibrous layer having series of waves or protuberances projecting generally perpendicularly from the plane of the layer, the waves or protuberances having a spacing frequency in the range of 2 to 8 per cm, the gathered layer having parallel rows of interconnected over-stitches of substantially inextensible, inelastic yarns stitched through the layer and extending generally along the longitudinal direction of the gathered layer, the over-stitches being in the range of 1 to 6 mm apart within each row, the parallel rows being in the range of 1 to 6 mm apart, the inextensible inelastic yarn amounting to in the range of 5 to 50% of the total weight of the stitched gathered layer, the overstitched gathered layer having a total weight in the range of 100 to 250 g/m2, a total thickness in the range of 1 to 8 mm, and a stretchability in the longitudinal and/or transverse direction of no greater than 20%.

6. A nonwoven fabric in accordance with claim 5 wherein the spacing frequency of the waves or protuberances is in the range of 4 to 6 per cm, the inextensible inelastic over-stitching yarn amounts to 10 to 25% of total weight of the fabric and is in the form of tricot stitches, and the stretchability of the nonwoven fabric is in the range of 5 to 15%.

7. A nonwoven fabric of claim 5 or 6 wherein the array of contracted elastic elements consists of elastic yarns stitch-bonded into the fibrous layer, said contracted elastic yarns and the over-stitched inelastic yarns each having stitch loops, the stitch loops of the contracted elastic yarns being separate from the stitch loops of the over-stitched inelastic yarn.

8. A nonwoven fabric of claim 7 wherein the fibrous layer and the overstitching are composed of non-flammable fibers.

9. A nonwoven fabric of claim 7 wherein the fibrous layer and the over-stitching are composed of absorbent fibers.

* * * * *